United States Patent [19]

Ikeda et al.

[11] Patent Number: 4,467,676

[45] Date of Patent: Aug. 28, 1984

[54] BOLT TIGHTENING DEVICE HAVING AUXILIARY HANDLE

[75] Inventors: Seiji Ikeda, Osaka; Katsuyuki Ono, Moriguchi; Shozo Matsumura, Toyonaka, all of Japan

[73] Assignee: Maeda Metal Industries, Ltd., Osaka, Japan

[21] Appl. No.: 397,928

[22] Filed: Jul. 13, 1982

[30] Foreign Application Priority Data

Feb. 25, 1982 [JP] Japan ..... 57-28194[U]

[51] Int. Cl.[3] ..... B25B 17/00

[52] U.S. Cl. ..... 81/56; 81/177 ST

[58] Field of Search ..... 81/55, 56, 177 ST

[56] References Cited

U.S. PATENT DOCUMENTS

| | | | |
|---|---|---|---|
| 2,578,279 | 12/1951 | Bardwell | 81/57.13 |
| 2,599,489 | 6/1953 | Schmidt | 81/177 ST |
| 2,928,302 | 3/1960 | Owen et al. | 81/56 |
| 3,633,446 | 1/1972 | Tadahira | 81/55 |
| 4,179,955 | 12/1979 | Akiyoshi et al. | 81/57.13 |

FOREIGN PATENT DOCUMENTS

| | | | |
|---|---|---|---|
| 67886 | 10/1957 | France | 81/177 STA |

*Primary Examiner*—James L. Jones, Jr.

*Attorney, Agent, or Firm*—Armstrong, Nikaido, Marmelstein & Kubovcik

[57] ABSTRACT

A bolt tightening device comprising a main body including a tubular case and a cylindrical housing attached to the base end of the tubular case approximately at a right angle therewith, the case being provided with an outer socket for a nut to fit in and an inner socket for fitting the tip of a bolt therein, a main handle fixed to the main body, and an auxiliary handle attached to the main body and having a grip approximately parallel to the cylindrical housing. The auxiliary handle is withdrawable from the housing toward the sockets and detachably engageable with positioning portions provided in or on the main body to clamp the main body when in a withdrawn position and in a pushed-in position.

10 Claims, 11 Drawing Figures

BOLT TIGHTENING DEVICE HAVING AUXILIARY HANDLE

BACKGROUND OF THE INVENTION

The present invention relates to a device for tightening bolts having a tip to be sheared, and more particularly to a bolt tightening device having an auxiliary handle withdrawably attached to its main body.

Bolt tightening devices of this type heretofore known have an inner socket 13 and an outer socket 14 at its forward end as seen in FIG. 10.

U.S. Pat. No. 2,928,302 discloses such a device for use with a bolt 70 so shaped as shown in FIG. 11 and having a tip 71 to be sheared and a nut 70 screwed on the bolt 7. The tip 71 is fitted in the inner socket 13 with the nut 70 engaged in the outer socket 14, and the sockets 13, 14 are driven to subject the bolt tip 71 to the tightening reaction of the nut 70 through the inner socket 13 and thereby shear the tip 71.

The bolt tightening device described above is complex in interior construction, composed of many parts, made sufficiently tough to withstand a great shearing force and therefore heavy. Accordingly the device has the problem that it is difficult to handle in balance by one hand gripping a handle 3 on the rear portion of its main body 1, consequently causing much fatigue to the user.

Further since the hand is used solely for gripping the handle 3, a switch 31 on the handle 3 is inconvenient to manipulate.

To solve these problems, the device is adapted for use with both hands, for example, by attaching a screw-type auxiliary handle 4 to the main body 1 as shown in FIG. 10.

However, the auxiliary handle 4 is likely to become an obstacle depending on the location of the bolt to be tightened, and the auxiliary handle 4 must then be removed, hence cumbersome. When thus removed from the device, the handle 4 must be carried about together with the main body 1. It is then bulky and likely to become lost.

SUMMARY OF THE INVENTION

An object of the present invention is to provide a bolt tightening device comprising an auxiliary handle which is withdrawably attached to its main body and which, when required, is usable as drawn out to a position to support the main body in balance together with the main handle of the device, the auxiliary handle being retractable onto the main body for accommodation so as not to become a hindrance when not in use.

Another object of the invention is to provide a bolt tightening device comprising an auxiliary handle which need not be separated from its main body for carrying about and which is conveniently portable without any likelihood of becoming lost.

DETAILED DESCRIPTION OF THE INVENTION

Figure 1:
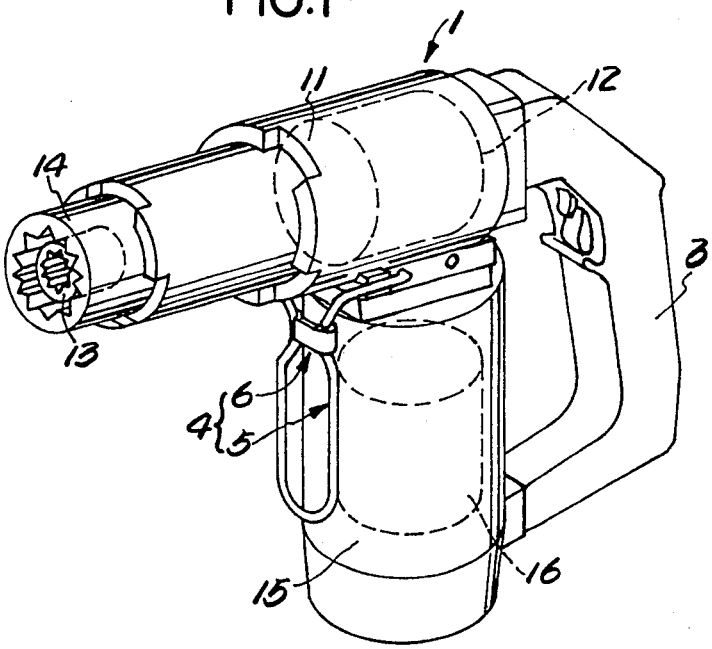
FIG. 1 is a perspective view showing a bolt tightening device.

FIG. 1 shows the main body 1 of a bolt tightening device. As already known, the main body 1 comprises a tubular case 11 having an inner socket 13 and an outer socket 14 arranged concentrically at its front end, and a cylindrical housing 15 attached to the base end of the case 11 approximately at a right angle therewith.

The tubular case 11 has accommodated therein a differential reduction gear 12 having an input shaft (not shown) which is coupled to a motor 16 within the housing 15. The reduction gear 12 has two coaxial output shafts (not shown) coupled to the sockets 13 and 14 individually.

A main handle 3 extends from the base end of the tubular case 11 to the lower end of the cylindrical housing 15 and is provided with an actuating switch 31.

The main handle 3 is of course positioned to the rear of the center of gravity of the main body 1.

Figure 2:
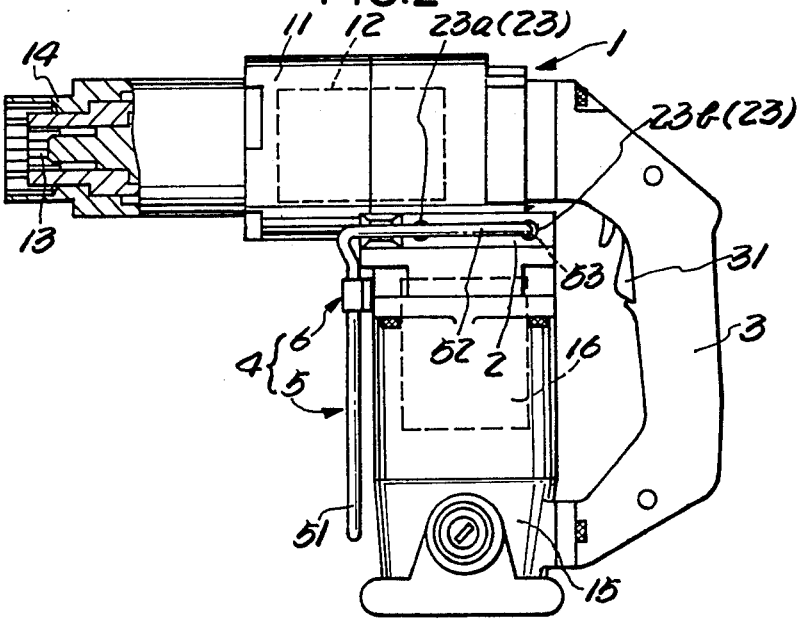
FIG. 2 is a front view showing the device with an auxiliary handle in its accommodated position.
Figure 3:
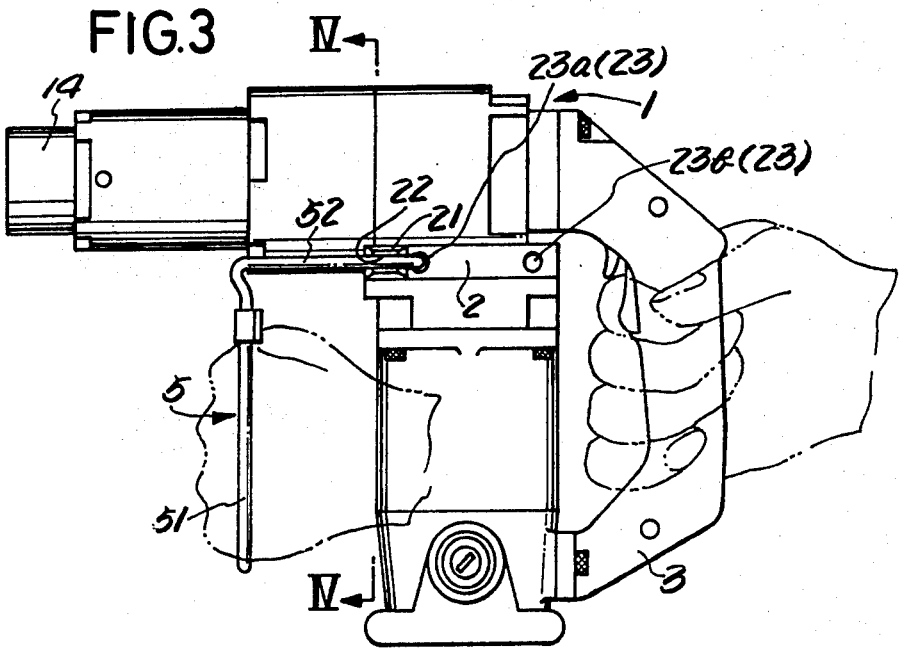
FIG. 3 is a front view showing the device with the auxiliary handle in a withdrawn position.
Figure 4:
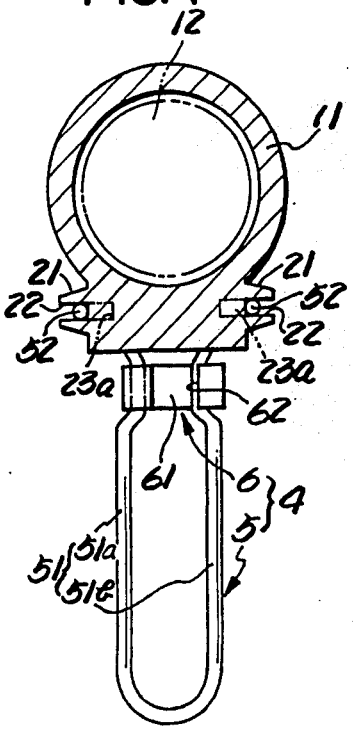
FIG. 4 is a view in section taken along the line IV—IV in FIG. 3.

As shown in FIGS. 2 and 3, an auxiliary handle 4, characteristic of the present invention, is provided on the housing 15 of the main body 1 and engageable in two bores **23*a* at a front portion of the main body 1 or in two bores 23*b*** at a rear portion thereof.

Figure 5:
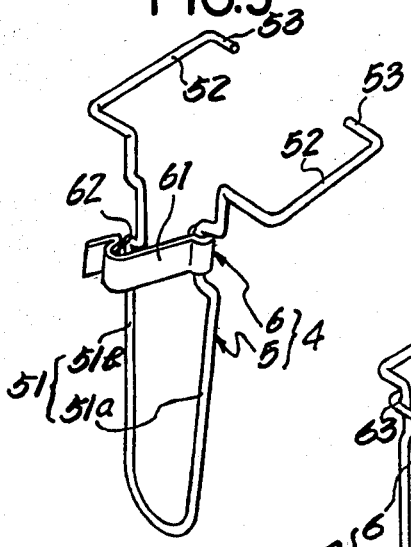
FIG. 5 is a perspective view showing the auxiliary handle.

As shown in FIG. 5, the auxiliary handle 4 comprises a main body 5 including a U-shaped grip 51, and a holder 6 for restraining the grip 51 from opening.

The handle main body 5 is formed by bending a thick metal wire. Openable rods **51*a*, 51*b* forming the grip 51 are slightly bent outward at their upper ends and further bent in parallel to each other in a plane perpendicular to the grip 51 to provide a pair of clamp pieces 52, 52**.

The clamp pieces 52, 52 for clamping the device main body 1 on the opposite sides thereof have forward ends which are bent inward toward each other to provide projections 53, 53 engageable in the bores **23*a* and 23*b* in the device main body 1**.

The grip 51 is slightly smaller than the housing 15 in length.

The length of the clamp pieces 52, 52 is so determined that the grip 51 will be positioned close to and lap over the housing 15 as shown in FIG. 2 when the projections 53 are fitted in the bores **23*b* in the device main body 1 closer to the main handle 3 as will be described later. The length is further such that when the projections 53 are fitted in the bores 23*a* closer to the sockets 13, 14, a sufficient space for gripping the grip 51 will be formed between the housing 15 and the grip 51, with the grip 51 positioned closer to the sockets 13, 14 than the center of gravity of the device main body 1 (see FIG. 3**).

The spacing between the projections 53, 53 at the forward end of the auxiliary handle is approximately equal to the thickness of the device main body 1 between the slide guide portions 2, 2 on the opposite sides thereof to be described later.

The holder 6 is in the form of an engaging plate 61 pivotably attached to the openable rod **51*a* of the grip 51 and bent at its free end to provide a resilient pawl 62**.

When the pawl 62 is pressed against the other openable rod 51*b* with the spacing between the rods 51*a*, 51*b* reduced by firmly gripping the grip 51, the pawl 62 is opened to engage the rod 51*b*.

The above-mentioned slide guide portions 2, 2, which are opposed to each other in parallel with the axis of the tubular case 11 for attaching the auxiliary handle 4 thereto, are formed on the opposite sides of the junction between the housing 15 and the case 11 of the main body 1. A projecting guide piece 21 is provided on each of the slide guide portions 2 at one end thereof closer to the sockets 13, 14.

The guide piece 21 is formed with a guide groove 22 in the direction of the slide guide portion 2 for slidably receiving the clamp piece 52 of the handle 4 therein.

The bores 23*a* and 23*b* are formed at the opposite ends of the slide guide portions 2, 2. These bores in which the projections 53, 53 of the auxiliary handle 4 are engageable serve as positioning portions 23 for the handle 4.

To install the auxiliary handle 4 in place, the opposite slide guide portions 2, 2 of the device main body 1 are held between the clamp pieces 52, 52 of the auxiliary handle 4, with the end projections 53, 53 of the clamp pieces 52, 52 opposed to the bores 23*a*, 23*a* in the slide guide portions 2, 2 closer to the sockets and with the clamp pieces 52, 52 opposed to the guide grooves 22, 22.

The spacing between the clamp pieces 52, 52 is reduced by firmly gripping the grip 51 by one hand to fit the clamp pieces 52, 52 into the guide grooves 22, 22 and the projections 53, 53 into the bores 23*a*, 23*a*.

The pawl 62 of the engaging plate 61 is pressed against the rod 51*b* into engagement therewith by the other hand to prevent the rods 52, 52, i.e. the grip 51, from opening.

Thus the auxiliary handle 4 is fixed to the device main body 1 with the clamp pieces 52, 52 held in the bores 23*a*, 23*a* and the guide grooves 22, 22.

Bolts are tightened up by the device as supported with both hands, with the main handle 3 gripped by one hand and the auxiliary handle 4 by the other hand. Since the auxiliary handle 4 and the main handle 3 are arranged in front and rear of the center of gravity of the device main body 1 to support the body in balance, the device can be handled easily in the desired posture as directed horizontally, upward or otherwise. The device is therefore less likely to cause fatigue to the operator even when used for a prolonged period of time.

Further because the auxiliary handle 4 is engaged in the guide grooves 22, 22 and in the bores 23*a*, 23*a* and thereby fixed to the main body 1 reliably, the handle 4 will not shake during work, rendering the device usable in a stable position.

When bolts are to be tightened up in a narrow space wherein the auxiliary handle 4 could be a hindrance or when the device is to be stored, the auxiliary handle 4 is held in a pushed-in position on the main body 1 toward the housing 15.

For this procedure, the pawl 62 is disengaged from the openable rod 51*b* to open the engaging plate 61 first, whereupon the grip 51 restores itself due to the resiliency of the metal wire to increase the spacing between the clamp pieces 52, 52 and disengage the end projections 53, 53 of these pieces from the bores 23*a*, 23*a*.

Subsequently the handle 4 is pushed in toward the main handle 3 in sliding contact with the slide guide portions 2, 2 on the main body 1 to oppose the handle projections 53, 53 to the rear bores 23*b*, 23*b*. The projections are then fitted into the bores 23*b*, 23*b* in the same manner as above by gripping the grip 51. The engaging plate 61 is held in place to prevent the grip 51, i.e. the clamp pieces 52, 52, from opening.

Since the auxiliary handle 4 is fixed to the main body 1 close to the housing 15 in lapping relation thereto, the device is in the same state as when it is not equipped with the handle 4. Thus it is usable free of any trouble even in a narrow space.

When required, the auxiliary handle 4 is withdrawn from the main body 1 in the reverse manner to the above.

Figure 6:
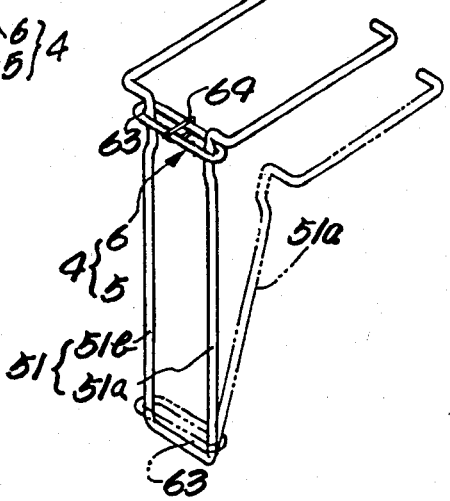
FIGS. 6 to 8 are perspective views showing other embodiments of auxiliary handle.
Figure 7:
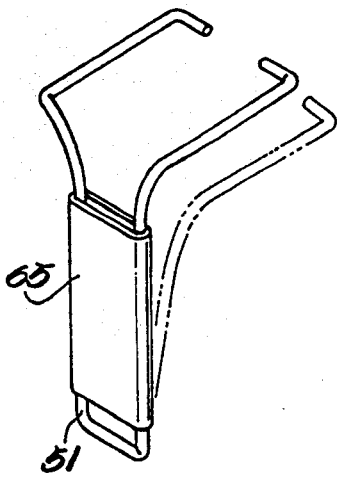

FIGS. 6 and 7 show other embodiments of holder 6 for the auxiliary handle 4. FIG. 6 shows a flat ring 63 slidably fitted around the openable rods 51*a*, 51*b* of the grip 51. When the ring 63 is lowered, the rods 51*a*, 51*b* resiliently move away from each other as indicated in broken lines.

The ring 63 has a retainer 64 for preventing the ring 63 from slipping off the grip 51.

FIG. 7 shows a flat tube 65 removably fitted around the grip 51. Since the flat tube 65 will be gripped for use, the auxiliary handle is easy to grip.

Figure 8:
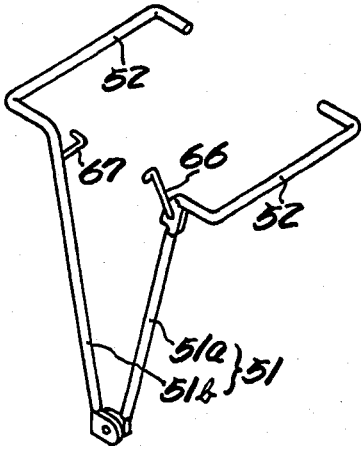

FIG. 8 shows another embodiment of auxiliary handle 4, wherein the handle main body 5 comprises two openable rods 51*a*, 51*b* pivoted to each other at the base end of a grip 51. A hook 66 is pivoted to the rod 51*a* and is engageable with a lug 67 on the other rod 51*b*.

After the device main body 1 is held between clamp pieces 52, 52, the hook 66 is engaged with the lug 67 to restrain the clamp pieces 52, 52 from opening.

Figure 9:
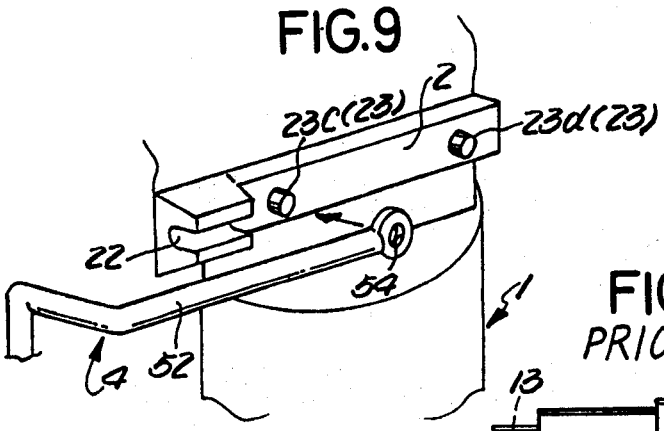
FIG. 9 is a perspective view showing a different embodiment of positioning portion.
Figure 10:
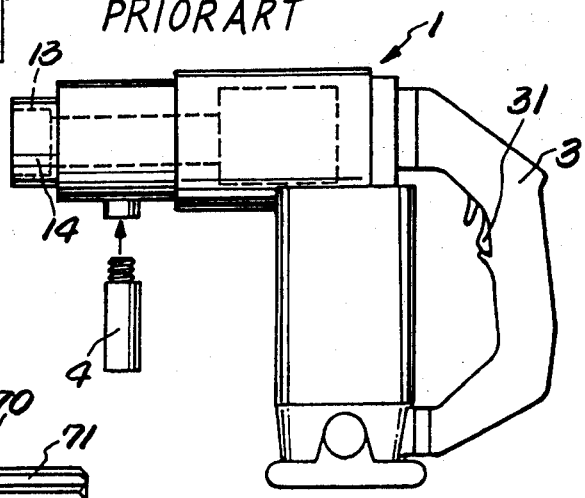
FIG.10 PRIOR ART
FIG. 10 is a front view showing a bolt tightening device having a conventional auxiliary handle.
Figure 11:
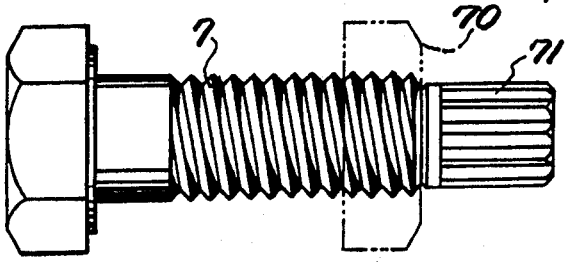
FIG.11 PRIOR ART
FIG. 11 is a front view showing a bolt.

In embodying the present invention, the portions 23 for positioning the auxiliary handle 4 in its withdrawn position and pushed-in position are not limited to the bores 23*a*, 23*b* described above but can be projections 23*c*, 23*d* shown in FIG. 9. In this case, the clamp piece 52 of the auxiliary handle 4 has a forward end formed with a hole 54 for fitting the projection 23*c* or 23*d* therein.

According to the invention described above, the auxiliary handle 4 can be withdrawn from the main body 1 immediately when needed for the user to grip the handle 4 and the main handle 3 and support the device with both hands, so that the device can be handled easily in any posture for bolt tightening.

The auxiliary handle 4, which can be held pushed in and lapped over the device main body 1, will not become a hindrance even when the device is used in a narrow space.

Furthermore, the auxiliary handle 4, which need not be separated from the device main body 1, is convenient to carry about and free of the likelihood of becoming lost and has various other advantages.

Because the auxiliary handle 4 can be made easily and inexpensively by bending a metal wire, the present device is available at a low cost.

The present invention is not limited to the foregoing description and the drawings but various modifications can be made in embodying the invention. It is to be understood that such modifications are included within the scope of the appended claims.

What is claimed is:

1. A bolt tightening device comprising:

a main body including a tubular case having a longitudinal axis;

a housing attached to the base end of said case approximately at a right angle therewith;

a main handle extending from the base end of said case to the outer end of said housing;

a pair of slide guide portions formed on opposite sides of said case at its junction with said housing and extending parallel to said axis, said slide guide portions each having positioning portions formed at each end of thereof; and an auxiliary handle comprising a grip member extending parallel to said housing and having a pair of parallel clamp pieces extending perpendicular therefrom, one of said clamp pieces being engaged in each of said slide guide portions, said clamp pieces being provided with engaging means at their ends for engaging said positioning portions, and means for adjustably engaging said engaging means with said positioning portions at either end of said slide guide portions whereby said auxiliary handle may be selectively moved between a withdrawn position and a pushed-in position.

2. The device as defined in claim 1 wherein said auxiliary handle is formed so that at said clamp pieces may be moved away from each other to disengage said engaging means, and said gripped member is provided with a holder to prevent such disengagement.

3. The device as defined in claim 2 wherein each of said positioning portions is a bore formed in said main body, and each of said clamp pieces has a forward end inwardly bent toward the other and engagable in one of said bores.

4. The device as defined in claim 2 wherein each of said positioning portions is a projection formed on said main body, and each of said clamp pieces has a formed with a hole for engaging said projection.

5. The device as defined in claim 2 wherein said auxiliary handle is formed integrally by bending a metal wire.

6. The device as defined in claim 2 wherein said auxiliary handle comprises two openable rods pivoted to each other at the base end of said grip member, and said clamp pieces extend from the openable ends of said rods.

7. The device as defined in claim 2 wherein said holder is a flat tube removably fitted to said grip member.

8. The device as defined in claim 2 wherein said holder is a flat ring slidably fitted to said grip member.

9. The device as defined in claim 2 wherein said grip member is composed of opposed openable rods, and said holder is an engaging plate pivotably attached to one of said rods and having at its free end a pawl engagable with said other rod.

10. A hand supported device comprising a main body having a main handle on the rear portion thereof, said device being provided with an adjustable auxiliary handle structure to provide two-handed support comprising:

a pair of opposed parallel slide guide portions formed on opposite sides of said main body;

two pairs of positioning portions formed in said slide guide portions;

a guide piece formed on each side of said main body, each said guide piece having therein a guide groove extending in the direction of a respective slide guide portion;

said auxiliary handle comprising a grip member and a pair of parallel clamp pieces extending prependicular therefrom, one of said clamp pieces being slideably received in each of said guide grooves;

engaging means formed at the end of each of said clamp pieces for engaging said positioning portions;

holder means provided on said grip member for retaining said engaging means in engagement with said positioning portions; and means for releasing said holder means whereby said clamp pieces may be disengaged from engaged positioning portions and slideably moved in said guide grooves to position said engaging means at other positioning portions to thereby adjust said auxiliary handle to either of two positions.

* * * * *